United States Patent [19]

Arens

[11] Patent Number: 4,649,679

[45] Date of Patent: Mar. 17, 1987

[54] RETAINER FOR RELEASABLE ATTACHMENT OF RAILS OR THE LIKE TO A SUPPORT

[76] Inventor: Erich Arens, Albertstrasse 11, 5900 Siegen, Fed. Rep. of Germany

[21] Appl. No.: 776,735

[22] Filed: Sep. 17, 1985

[30] Foreign Application Priority Data

Sep. 17, 1984 [DE] Fed. Rep. of Germany ..... 3434069

[51] Int. Cl.[4] ..... B32B 3/00

[52] U.S. Cl. ..... 52/181; 24/460; 52/465; 52/469; 403/341; 403/364; 428/53; 428/122

[58] Field of Search ..... 52/181, 312, 465, 469, 52/584, 824, 730; 24/459, 460, 573, 625, 702; 428/53, 59, 98, 99, 122, 83; 403/341, 364, 374

[56] References Cited

U.S. PATENT DOCUMENTS

| | | | |
|---|---|---|---|
| 893,198 | 7/1908 | Schachner | 52/181 |
| 1,063,318 | 6/1913 | Bartels | 52/584 |
| 2,181,812 | 11/1939 | Kammerer | 52/181 |
| 2,268,636 | 1/1942 | Becker | 52/469 X |
| 3,334,456 | 8/1967 | Naka | 52/181 X |
| 3,783,471 | 1/1974 | McGeary et al. | 52/181 X |
| 4,504,168 | 3/1985 | Miller | 24/625 X |
| 4,590,110 | 5/1986 | Arens | 15/217 X |

FOREIGN PATENT DOCUMENTS

| | | | |
|---|---|---|---|
| 0125618 | 11/1984 | European Pat. Off. . | |
| 2412151 | 9/1975 | Fed. Rep. of Germany . | |
| 2719857 | 10/1978 | Fed. Rep. of Germany . | |
| 3317410 | 11/1984 | Fed. Rep. of Germany . | |
| 777505 | 6/1957 | United Kingdom | 24/459 |
| 2125289 | 3/1984 | United Kingdom | 428/95 |
| 737284 | 5/1980 | U.S.S.R. | 403/364 |

*Primary Examiner*—Alfred C. Perham
*Attorney, Agent, or Firm*—Karl F. Ross; Herbert Dubno

[57] ABSTRACT

A retainer for releasable attachment of an insertable bar, strip, or the like to a support comprises a supporting channel mountable on the support, engageable in the supporting channel a retaining rail, in which the insertable bar, strip, or the like is detachably secured, and a first means for releasable attachment of the retaining rail to the supporting channel provided in the supporting channel. The retaining rail has two longitudinal flanges whose free edges have directed inwardly a plurality of protruding members with which the insertable bar, strip, or the like is held in the retaining rail. In order to make easier the mounting of the insertable bar, strip, or the like the retaining rail further comprises two retaining rail sections shaped for interlocking engagement with each other, these retaining rail sections having a second means for releasable attachment of the retaining rail to the supporting shoe, wherein this second means is detachably engageable with said first means, by which the retaining rail having the insertable bar, strip, or the like therein is fit to and locked in the supporting channel.

14 Claims, 5 Drawing Figures

RETAINER FOR RELEASABLE ATTACHMENT OF RAILS OR THE LIKE TO A SUPPORT

FIELD OF THE INVENTION

My present invention relates to a retainer for the releasable attachment of elongate elements, broadly referred to as rails or the like to a support and, more particularly, to a retainer for the releasable attachment of insertable rails, bars, or strip-like elements, comprising felt, brush material, rubber, or having a textile material top portion, to channel segments with longitudinal grooves oriented parallel to each other suitable for construction of grids for floor mats or foot scrapers, and also to retainers which can be used to attach covering rails, bars, modules, or panels to walls and under roofs of buildings.

BACKGROUND OF THE INVENTION

Known retainers for releasable attachment of elongate elements such as rails and the like to a support comprise a supporting shoe mountable on the support, in one case having two parallel side walls projecting up from a base, a retaining rail in the shoe, which is insertable between the side walls of the supporting shoe as well as locable into an undercut region of the supporting shoe.

A first means for attaching and holding the retaining rail in the supporting shoe is also provided. This retaining rail has two parallel flanges contact the inside of the supporting shoe, these parallel flanges having adjacent their free edges directed inwardly, protruding members, such as cams, pins, or the like, by which the insertable elongate element is held in the retaining rail.

Known grids for the construction of floor mats or foot scrapers comprise a plurality of supporting shoes, supporting bars, or the like having undercut grooves in their longitudinal directions oriented with their longitudinal axes parallel to each other, holding elements for assembling the supporting shoes, channels or the like with clearance from each other, and in whose supporting shoes, bars, or the like; flexible insertable strips, rails, or the like to be mounted therein, for example insertable strips or rails comprising felt, brush material, rubber, or having a textile top portion; are placed.

The insertable strips or rails to be mounted are held in thin walled retaining rails comprising two lateral flanges each and a strip uniting them. These thin walled retaining rails are formed from a compressible hard material, for example a hard plastic material. The retaining rails with the insertable strips, rails, or the like are locked into the supporting shoes, bars or the like.

While holding elements with undercut formed head members are pressed in an undercut groove on the underside of the supporting shoes, supporting bars or the like, the retaining rails formed from the hard compressible material are engaged in the groove in the upper side of these supporting rails, bars or the like, as taught for example in the German patent document-open application DE-AS No. 27 19 857.

In order to make grids for floor mats or foot scrapers with a minimum height and area, individual components can be joined into a single structure by a press fastner system utilizing as is set forth in German patent application P No. 33 17 410.5 and European patent application No. 84 10 5223.6, the undercutting of the upper and lower sides of the supporting channel, supporting bar, or the like to provide both on the one hand supporting channels serving as receptacles for holding the flexible insertable strips, rails or the like, and on the other hand grooves next to each other of approximately the same height for engagement of the holding elements, and furthermore to provide three undercut grooves over the width of the supporting channel or the like in an arrangement symmetrical with respect to its longitudinal axis.

In another case on the underside of the supporting channel, bar or the like, two undercut longitudinal grooves are positioned edgewise or engage holding elements, while on the upper side of the supporting channel an undercut longitudinal groove symmetric with respect to the longitudinal axis of the rail is provided as a receptacle for a retaining rail formed for holding the flexible insertable strip, rail or the like.

There is another possible alternative in which on the underside of the supporting channel, supporting bar, or the like only one undercut longitudinal groove symmtric with respect to its long axis is provided to engage the holding elements, while on the upper side of the supporting channel to undercut longitudinal grooves are found which provide a receptacle for a retaining rail formed to hold the flexible insertable strip, rail or the like which is to be mounted therein.

The structure of the components for the construction of grids for making floor mats or foot scrapers, the supporting channels, supporting bars or the like, the holding elements which bind the supporting channels together with clearance from each other, and also the flexible insertable strips, rails, or the like, for example comprising felt, brush material, rubber, or having a textile top portion, and also the retaining rail structured to receive the insertable strip or rail and to be locked into the supporting channel or the like, have in practice a particular importance, in that their manufacture from plastic, and also metal, is possible in such a way, that allows assembly of these individual components in an easy way, that allows reliable and problem easy construction mounting even in congested workplaces.

Although the previously disclosed structures for the grid for making floor mats or foot scrapers already provides mounting conditions which allow a large size according to each of the previously mentioned prior art retainers set forth, practical experience shows that particularly the method or order of insertion of the flexible insertable strips, rails, or the like in the retaining rails, constructed of a compressible hard material, used to lock them into the supporting channels, bars, or the like can cause difficulty, because a certain force is required, which cannot always be applied manually especially when the insertable strip and the retaining rails serving to hold it have a comparatively large length.

OBJECTS OF THE INVENTION

My invention is aimed at removing barriers to lengthening the known grids. It is therefore an aim of my invention to provide a retainer for this kind for releasable attachment of rails, strips, or the like to a support, in which attachment is possible with the smalles possible applied force, and of course chiefly by hand in a heavy factory in construction of grids for making floor mats or foot scrapers, in order to insure the secure holding of the insertable strips, rails or the like, comprising felt, brush material, rubber, or a material with a textile top, into the retaining rail section, or the like provided with longitudinal groove and oriented parallel to each other. However at the same time the retainer of my invention should maintain the disclosed structure, which allows its use with a variety of other inserts, and hence a manufacture of its components takes place in such a large quantity, that production costs are minimized.

Specifically, therefore, it is an object of my invention to provide an improved retainer for releasable attachment of an elongate element to a support.

It is also an object of my invention to provide an improved retainer for releasable attachment of an insertable bar, strip, or the like to a support, which can be longer than those of the prior art, while at the same time being easily assembled by hand at the desired site.

It is a further object of my invention to provide an improved retainer for releasable attachment of an insertable rail, strip, or the like to a support, in which attachment is possible with the smallest possible applied force, and thus assembly of longer retainers than those of the prior art may be made easily manually.

It is yet another object of my invention to provide an improved and more versatile retainer for releasable attachment of an insertable bar, strip, or the like to a support, which is assembled from less expensive, mass produced components than those of the prior art, and has thus an improved competitiveness.

It is also an object of my invention to provide an improved retainer for releasable attachment of a rail, strip, or the like to a support, in which that attachment is secure but can be easily made manually.

SUMMARY OF THE INVENTION

These objects and others which will become more apparent hereinafter are attained in accordance with my invention in a retainer for releasable attachment of an insertable bar, strip, or the like to a support comprising a supporting channel mountable on the support, in a preferred case having two parallel side walls projecting up from a base, and engageable in the supporting channel a retaining rail, which in the preferred case is insertable between the side walls of the supporting channel as well as locable into an undercut region of the supporting channel. A first means for attaching and holding the retaining rail in the supporting channel is provided. This retaining rail has two parallel lateral flanges in the preferred case contacting the inside of the side walls of the supporting channel, these parallel lateral flanges having adjacent their free edges directed inwardly a plurality of protruding members, such as cams, pins, or the like, with which the insertable strip, rail, or the like is held in the retaining rail.

According to my invention the retaining rail comprises two retaining rail sections shaped for interlocking engagement with each other, these retaining rail sections having a second means for releasable attachment of the retaining rail to the supporting channel, wherein the second means is detachably engageable with the first means, by which the retaining rail having the insertable rail, strip, or the like, is fit to and locked in the supporting shoe.

In the preferred case of my invention the supporting channel is provided with a bar longitudinally running centrally between its side walls. The height of this bar corresponds to only a fraction of the height of, or in other words is much less than the height of its side rails. The bar is provided with a symmetrically thickened enlargement on its free longitudinal edge.

Furthermore the retaining rail comprises two retaining rail sections pushed together onto its common center plane, which as the second means of attachment have toothlike foot portions, for example indented or notched, lying in engagement with each other projecting from alternating retaining rail sections, and the free end piece of each foot portion has a hook or clawlike form, with which it engages the enlargement of the bar in the supporting shoe from above and from opposing sides.

The arrangement and structure of the foot portion with its hook or clawlike endpiece on each of the retaining rail sections is such that the toothlike adjacent foot portions of the right retaining rail section with their hook or clawlike endpieces on the left side engage the enlargement of the bar running along the supporting channel, while similarly the toothlike adjacent foot portions, of the left retaining rail section with their hook or clawlike endpieces on the right side engage the enlargement of the bar running along the supporting channel.

The particular advantage of this structure for the retainer is that each retaining rail section of the retaining rail can be brought to the longitudinal lateral sides of the insertable bar, strip, or the like to be mounted from opposite sides, so that the protruding members, the cams, pins or the like, on the inside of the lateral flanges of the retaining rail press into the material of the insertable bar, strip, or the like, until the lateral flanges come into contact with the longitudinal lateral surfaces of the insertable bar, strip or the like.

Thus the retaining rail formed from the toothed rail sections engaged with each other may be pushed longitudinally onto the supporting channel, so that in the preferred case for example the claw or hooklike endpieces of its toothlike foot portions engage the longitudinal bar of the supporting channel, while its lateral flanges come into contact with the inside of the side walls of the supporting channel.

On the other hand it is also possible to press in the retaining rail holding the insertable bar, strip, or the like to be mounted from above onto the supporting channel, whereby preferably the claw or hooklike endpieces can be elastically spread from each other, while it slides over the thickened enlargement of the central bar running longitudinally in the supporting channel.

A grid is already known, of course, as taught in German patent document DE-AS No. 24 12 151, comprising a plurality of parallel supporting channels provided with undercut grooves running in their longitudinal direction. The wall bounding the bottom groove of these supporting channels has a bendable elastic portion running in the longitudinal direction, which allows the spreading of the supporting channels, in order to put in the insertable bar, strip, or the like. Into grooves of the supporting channels the top members of the holding elements are inserted, whereby the supporting shoes are held with clearance parallel to each other. With a supporting channel, supporting bar, or the like of this kind however a retainer in the sense of my invention cannot be constructed.

According to a preferred embodiment of my invention, the abutting surfaces on the retaining rail sections abutting against each other in the assembled retaining rail are formed by shoulders running continuously over the entire length of the retaining rail sections, to whose underside each toothlike foot portion is connected by a leg oriented at right angles to it, from which that free endpiece is oriented at a right angle to the retaining rail section.

In a further feature of my invention, the side walls of the suporting channel each have a steplike ledge which is equal in height to the height of the upper edge of the centrally running bar, and on which the retaining rail sections of the retaining rail are supported.

Preferably the retaining rail sections of the retaining rails have three section pieces oriented substantially at right angles to each other, of which a first forms the lateral flange having the protruding members on its inside surface, a second of which is provided with the foot portions with the hook or clawlike endpieces, for example by copping, and the abutting surfaces of the shoulders are formed along the entire length of the retaining rails continuously on the middle, third section piece.

In a particularly desirable specific embodiment of the retainer according to my invention, the total width of both the third middle section pieces of the retaining rail sections assembled into the retaining rail and forming the bottom member thereof corresponds to the width of the side walls at a height above the steplike ledges, while the width of the foot portions of the retaining rail is smaller than the clearance between the side walls inside the supporting channel below the steplike ledges.

The side walls of the supporting channel can have the same thickness at all elevations thereon over their entire height and each retaining rail section forming the retaining rail can have an extension lying essentially parallel to the free end pieces of the foot portions with the flange of the rail section in the same plane as that extension, which rests with its end surfaces on the base of the supporting channel.

The indentations or notches between adjacent pairs of foot portions on the same retaining rail section under the middle section piece of that rail section can be bounded by curved surfaces, while the foot portions on their free endpieces have end surfaces parallel to the abutting surfaces of the shoulders. By suitably conforming the foot portions on both rail sections of the retaining rail, it is possible to hold those foot portions fixed clamped at the beginning of the curved surfaces on pressing together the rail sections, and because of that the retaining rail with the insertable strips, rails or the like therein is held together securely.

The end surfaces of the free end pieces on the foot portions can each be provided with a freely projecting tongue, which engages between an adjacent pair of foot portions on the same retaining rail section fitting in the notch or indentation therebetween.

Retainers according to my invention can also be used without difficulty, when insertable strips, bars, plates, tablelike bodies or the like must be attached securely and easily to cover walls or under roofs or to supports and the like. In these cases the supporting channel with a preselected comparatively small length measurement is attached to the support, for example with screws driven through its base, while both retaining rail sections of the retaining rail are clamped together with their insertable strip, bar, table, plate, or the like between them, before they are brought into locking engagement with the supporting channel.

BRIEF DESCRIPTION OF THE DRAWING

The above and other objects, features and advantages of my invention will become more readily apparent from the following specific description, reference being made to the accompanying drawing in which.

SPECIFIC DESCRIPTION

Figure 3:
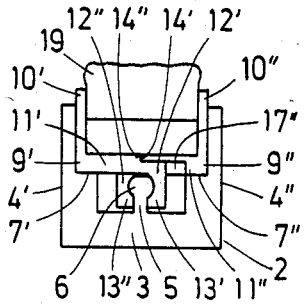
FIG. 3 is an end view of the retainer shown in FIG. 1 as seen in the direction of the arrow III.

In the drawing a substantially bar-shaped structural element 1 is shown as an example of a retainer according to my invention, which is chiefly used in the construction of a grid for use as a floor mat or foot scraper.

The retainer is also suitable for other construction purposes, for example it can be used for attachment of rails, strips, panels, sheets, plates, tables, or the like to walls or under roofs in building.

This retainer 1 comprising two side walls has a supporting channel 2 comprising two side walls 4' and 4'' projecting up from a base 3 comprising two side walls, and centered between the side walls 4' and 4'' a longitudinally running bar 5, which is provided with a symmetrically thickened longitudinal enlargement 6 at its free longitudinal (upper) edge.

The supporting channel 2 can be constructed as a comparatively long bar or rail segment, as is required in construction of grids for floor mats and foot scrapers, wherein several supporting channels 2 oriented with clearance parallel to each other can be bound together by holding elements running traverse to the supporting channels 2.

From the drawing it is apparent, that the bar 5 with its thickened longitudinal enlargement 6 positioned running centrally between the side walls 4' and 4'' has a height, which is only a fraction of the height of the side walls 4' and 4''.

Figure 1:
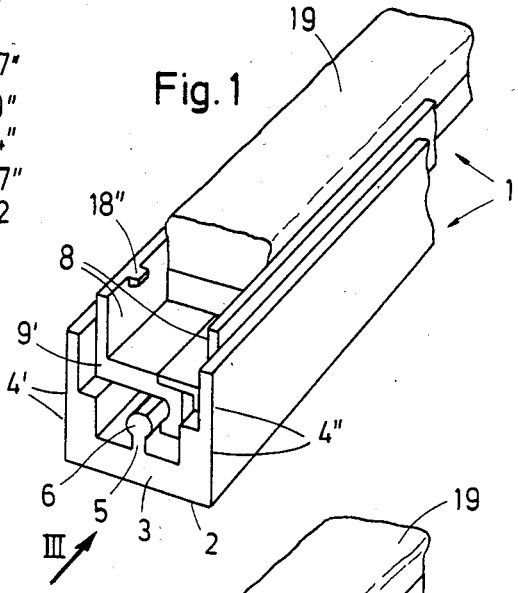
FIG. 1 is a perspective view of a preferred embodiment of a retainer for releasable attachment of a bar, strip, or the like according to my invention, having a supporting channel which may be used to made a grid used in the construction of floor mats or foot scrapers.
Figure 2:
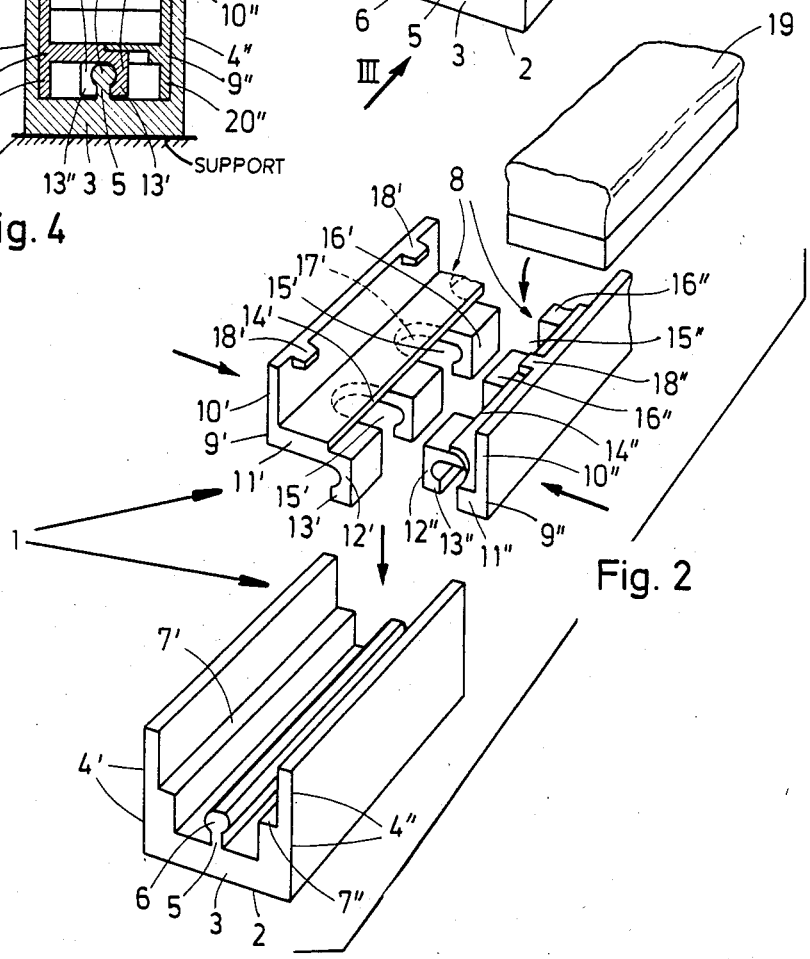
FIG. 2 is an exploded perspective view of the individual components of the retainer of FIG. 1 seen before assembly.

In the embodiment of FIGS. 1 to 3 the interior sides of the side walls 4' and 4'' of the supporting channel 2 are each provided with a steplike ledge 7' or 7'' of substantially the same height as the top edge surface of the longitudinally running bar 5, so that the support channel 2 below the ledges 7' and 7'' running the entire length of the supporting channel 2 has an interior width, which is considerably smaller than the interior width between the free edges of these side walls 4' and 4''.

The supporting channel 2 thus has, as is particularly seen in FIG. 2, an essentially E-shaped cross section. The retainer 1 further comprises a retaining rail 8, which is formed or put together from two retaining rail sections 9' and 9''.

These retaining rail sections 9' and 9'' have therefore cross sections complimenting each other, wherein they each have three section pieces 10', 11', 12' or 10'', 11'', 12'' oriented perpendicularly to each other, and—in regard to the cross section—are mirror images of each other as seen with each in a position which can be coupled to the other to make the retaining rail 8.

Each of the retaining rail sections 9' and 9" comprise a section piece 11' or 11' along its entire length functioning as a bottom member 11' or 11', which is provided with abutting surfaces on shoulders 14' or 14" lying parallel to the section piece 10' or 10" operating as a lateral wall or lateral flange 10' or 10" of the retaining rail 8. The abutting surfaces of the shoulders 14' and 14" of the bottom member or section pieces 11' and 11" lie flush with each other on the longitudinal center plane of the assembled retaining rail 8, as is particularly clearly seen in FIGS. 1 and 3.

While a component piece of the section piece 11' or 11" jutting past the abutting surfaces of shoulders 14' or 14" or the shoulders 14' or 14" connects to the section piece 12' or 12" with the hooklike or clawlike end piece 13' or 13" below it, the retaining rail sections 9' or 9" are necessarily provided with recesses 15' or 15" longitudinally positioned with clearance from each other, between which toothlike members 16' or 16" sit connected to the shoulders 14' and 14". These toothlike members 16' and 16" have moreover such a width and are positioned staggered with respect to each other, so that in the longitudinal direction a toothlike member 16' of the retaining rail section 9' is engaged in a recess 15" of the other retaining rail section 9" and similarly a toothlike projection 16" of the retaining rail section 9" is engaged in the recess 15' of the opposing retaining rail 9' with slight play. In the longitudinal direction of the retaining rail 8 therefore an interlocked coupling of each of the retaining rail sections 9' and 9" results. When moreover the abutting surfaces of the shoulders 14' and 14" of the rail sections 9' and 9" press flush against the longitudinal center plane of the retaining rail 8, then the hook or clawlike end pieces 13' of the section piece 12' forming the foot portion of the left retaining rail section 9' lies to the right of the longitudinal midplane of the retaining rail 8 (for example, as seen in FIG. 2), whereas similarly the hook or clawlike end pieces 13" of the section piece 12" forming the foot portions of the right retaining rail section 9" lies left of the longitudinal midplane of the retaining rail 8, as can be clearly seen in FIG. 3.

Figure 5:
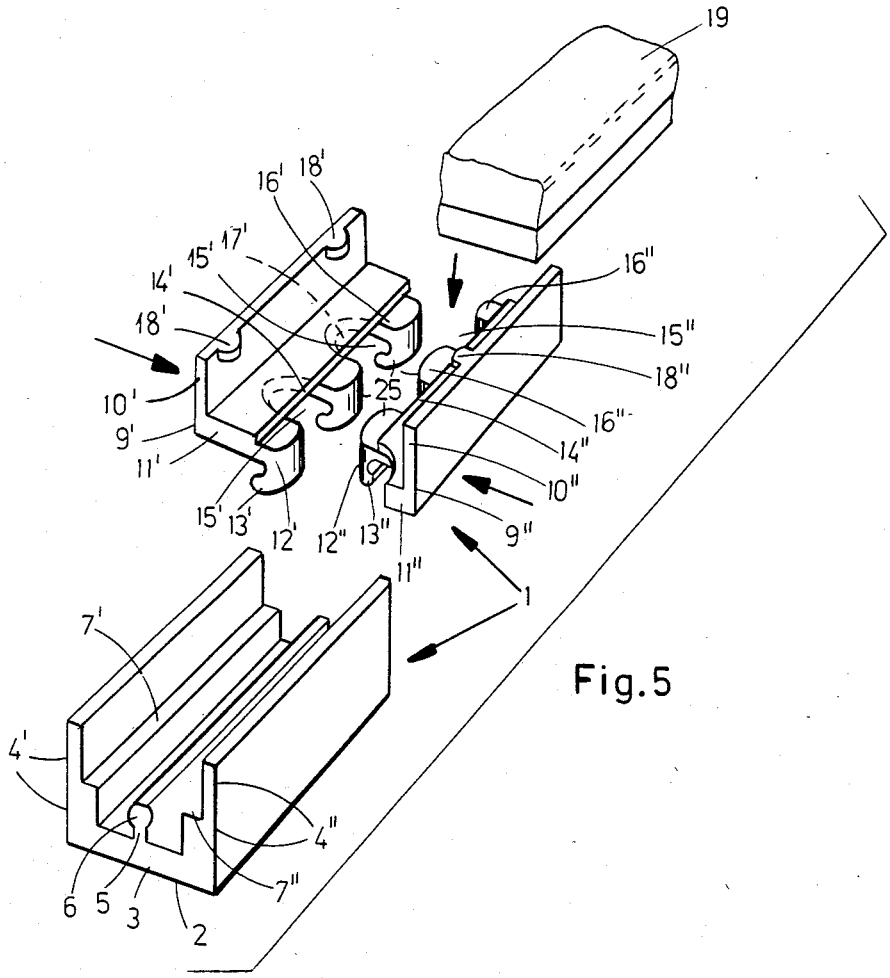
FIG. 5 is an exploded perspective view of the individual components of another preferred embodiment of a retainer according to my invention as seen before assembly.

In FIG. 2 the drawing indicates that the section piece 11' of the retaining rail section 9' has molded indentations or notches 17' connected to the recesses 15' and under the shoulder 14' and also the rail section 9" has corresponding indentations or notches 17", whose ends are bounded by curved surfaces. The toothlike pieces 16' and 16" of the section pieces 12' and 12" forming the foot portions however lie with their end surfaces parallel to the abutting surfaces of the shoulders 14' and 14", with which they engage in recesses 15' and 15" until in the vicinity of the indentations or notches 17" or 17", and there, if necessary, can be clamped in the vicinity of the curved surfaces. To be sure it is also conceivable as shown in the alternative embodiments of FIG. 5, to allow tongues 25 to freely project out from the end surfaces of the section piece 12' and 12", which have curved surfaces, and which engage in the opposing rail sections 9' and 9" fitting in their indentations or notches 17' and 17".

On the inside of the section piece 10' or 10" of the retaining rail sections 9' or 9" operating as a flange the protruding members 18' or 18" are positioned. These protruding members 18' or 18", which may be cams, pins, studs or the like, can moreover press into the longitudinal lateral surfaces of the workpiece, that is, the insertable bar, strip or the like 19, and hold it fixed against lifting or longitudinal shifting. The latter can be a felt-top bar or brush.

After both retaining rail sections 9' and 9" are coupled to each other while simultaneously being attached to the workpiece rail, strip, or the like 19, the retaining rail 8 can be slid either in the longitudinal direction onto the supporting channel 2, or however can be pressed onto the supporting channel 2 from above. Moreover the hook or clawlike end pieces 13' and 13" of the section pieces 12' and 12" forming the foot portions are then in interlocked engagement with the longitudinal swelling 6 of the bar 5 on the supporting channel 2. Simultaneously each retaining rail section 9' and 9" sits with the underside of the section pieces 11' and 11' supported on the ledges 7' and 7" of the side walls 4' and 4" of the supporting channel 2, and the flanges of the retaining rail 8 formed by the section pieces 10' and 10" contact and press on the inside of the side walls 4' and 4" of the supporting channel 2 above the ledges 7' and 7".

As can be learned particularly from FIG. 3 the total width of the section pieces 11' and 11" having the shoulders 14' and 14" and forming the bottom member from which the retaining rail 8 in the vicinity of its section pieces 12' and 12" forming the foot portions is smaller than the clearance between the side walls 4' and 4" in the interior of the supporting channel 2 below the steplike ledges 7' and 7" and in which the bar 5 runs. Thereby it is guaranteed that the section pieces 12' and 12" forming the foot portions can be deformed elastically without difficulty, while being pressed in the support rail 8, while being slid on the thickened enlargement 6.

Figure 4:
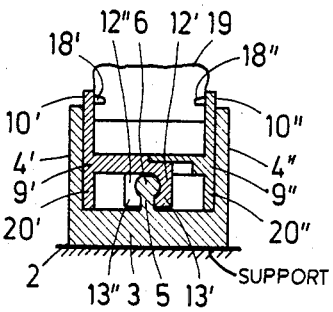
FIG. 4 is a cross sectional view through another embodiment of a retainer according to my invention with a different structure from that of FIGS. 1 to 3.

In FIG. 4 a retainer for releasable attachment of rails, strips, or the like to a support is shown, which has a somewhat different structure from the specific embodiment according to FIGS. 1 to 3. Here the supporting channel 2 is provided with two side walls 4' and 4" projecting from its base 3, which have the same thickness along their entire height. Both retaining rail sections 9' and 9" forming the retaining rail 8 are provided with extensions 20' and 20", which extend substantially parallel to the section pieces 12' and 12" forming the foot portions and moreover can rest with lateral clearance from these with their ends on the base 3. The rest of the retainer 1 has the same structure and also the same operation as the embodiment according to FIGS. 1 to 3.

The preceding illustrate a retainer according to my invention, of course, as embodied in the disclosed structural element 1 combined with a grate bar 19 for construction of floor mats or fast scrapers. The retainer 1 without more may be used for other purposes. Thus it is suitable, for example, in a particularly advantageous way for attachment of rails, sheets, plates, tables or the like to walls or below roofs, as is variously required in interior construction of buildings. In this case then the retaining rail sections 9' and 9" forming the retaining rail 8 are merely maintained or provided with suitable gripping or engaging elements on their backsides, while being applied to the wall or the base of the support channel 2 in such a position and with such dimensions, that allows the retaining rail 8 clamped to the rail, sheet, plate, or the like to be mounted to be pressed into releasable attachment with the supporting channel 2.

Reference may be had, for the use of the system of the invention, to my copending application Ser. No. 610,242 filed May 24, 1984 now U.S. Pat. No. 4,590,110.

I claim:

1. In a retainer for releasable attachment of an insertable bar, strip, or the like to a support comprising a supporting channel having two parallel side walls projecting up from a base, and a retaining rail insertable between said side walls in said supporting channel as well as lockable into an undercut region of said supporting channel, said retaining rail having two parallel lateral flanges contactable with the inside of said side walls of said supporting channel, the free edges of said parallel lateral flanges having directed inwardly a plurality of protruding members with which said insertable bar, strip or the like is held in said retaining rail, the improvement wherein said supporting channel is provided with a bar running longitudinally centered between said side walls, the height of said bar being much smaller than the height of said side rails, and on the free long edge of said bar a symmetrically thickened enlargement is provided, said retaining rail further comprises two retaining rail sections pressed together on the common center plane of said retaining rail, said two retaining rail sections having toothlike foot portions lying in engagement with each other, adjacent ones of said toothlike foot portions projecting from alternating ones of said two retaining rail sections, and the free end piece of each of said foot portions has a hooklike form, with which said foot portions engage the enlargement of said bar in said supporting channel from above and from opposing sides thereof.

2. The improvement according to claim 1 wherein an abutting surface of each of said two retaining rail sections, which abut against each other in said retaining rail when assembled, is formed by a shoulder running continuously over the entire length of said retaining rail sections, each of said toothlike foot portions being connected to the underside of one of said shoulders by a leg oriented at right angles to said retaining rail sections.

3. The improvement according to claim 2 wherein said side walls of said supporting channel each have a steplike ledge, which is equal in height to the height of the upper edge of said bar running centrally therebetween, and on which said retaining rail sections of said retaining rail are supported beneath said lateral flanges of said retaining rail.

4. The improvement according to claim 3 wherein said retaining rail sections of said retaining rails each comprise three section pieces oriented substantially at right angles to each other, a first of which forms one of said lateral flanges of said retaining rail having said protruding members thereon directed inwardly, a second of which is provided with said foot portions and said endpieces having said hooklike form, and on a third, middle one of said three section pieces said abutting surface of said shoulder is formed running continuously over the entire length of said retaining rail.

5. The improvement according to claim 4 wherein the total width of both of said third middle section pieces of said retaining rail sections assembled into said retaining rail and forming the bottom member thereof corresponds to the interior width between said side walls at a height above said steplike ledges, while the width of said foot portions is smaller than the clearance between the side walls inside said supporting channel below said steplike ledges.

6. The improvement according to claim 4 wherein said side walls of said supporting channel have equal thickness at any elevation thereon and each of said retaining rail sections forming said retaining rails has an extension essentially parallel to said free end pieces of said foot portion with said lateral flanges of said retaining rail sections in the same planes as said extensions, whose end surfaces rest on said base of said supporting channel.

7. The improvement according to claim 6 wherein an indentation provided between every adjacent pairs of said foot portions on the same one of said retaining rail section under said third, middle ones of said section pieces of said retaining rail sections is bounded by a curved surface, while said free end pieces of said foot portions have end surfaces parallel to said abutting surfaces of said shoulders.

8. The improvement according to claim 7 wherein said end surfaces of said free end pieces of said foot portions are each provided with a freely projecting tongue, which engages between said adjacent pair of said foot portions fitting in said indentation therebetween.

9. In a retainer according to claim 1, wherein said supporting channel has two paralle side walls projecting up from above, and said retaining rail is insertable between said side walls and is moreover engagable in an undercut region of said supporting channel, the improvement wherein said first means for releasable attachment of said retaining rail of said supporting channel comprises a bar longitudinally running centered between said side walls, the height of said bar being much smaller than the height of said side rails, and on the free long edge of said bar a symmetrically thickened enlargement is provided, and said second means of releasable attachment of said retaining rail to said supporting channel comprises a plurality of toothlike foot portions provided on said retaining rail sections lying in engagement with each other, adjacent ones of said plurality of said toothlike foot portions projecting from alternating ones of said two rail sections, and the free endpiece of each of said foot portions has a hooklike form, with which said foot portions engage said enlargement of said bar in said supporting channel from above and alternatingly from opposing sides thereof.

10. In a retainer for releasable attachment of an insertable bar, strip, or the like to a support comprising a supporting channel mounted on said support, engageable in said supporting channel a retaining rail, in which said insertable bar, strip or the like is detachably secured, and a first means for releasable attachment of said retaining rail to said supporting channel provided in said supporting channel, said retaining rail having two longitudinal flanges whose free edges have directed inwardly a plurality of protruding members with which said insertable bar, strip, or the like is held in said retaining rail, the improvement wherein said retaining rail comprises two retaining rail sections shaped for interlocking engagement with each other, said retaining rail sections having a second means for releasable attachment of said retaining rail to said supporting channel, wherein said second means is detachably engagable with said first means, by which the retaining rail having said insertable bar, strip, or the like therein is fit to and locked in said supporting channel.

11. A retainer for an elongate element adapted to form a grate, comprising:

a retaining channel having a pair of side walls rising from a base, and a central rib rising from said base between said walls, said rib being formed at an upper edge and below upper edges of said side walls with a bead; and a rail received in said channel and composed to two elongated members together defining a groove for receiving said element, each of said members having a row of hooks interdigitating with hooks of the other member below said groove, the hooks of said members reaching around said bead from opposite sides to formfittingly engage said bead.

12. The retainer defined in claim 11 wherein said groove is defined by flanks of said members lying along said sides.

13. The retainer defined in claim 12 wherein each of said sides is stepped to form a ledge, said flanks extending from bases of the respective member seated on the respective ledge.

14. The retainer defined in claim 12 wherein said members have bases extending over recesses formed between hooks of the respective member, said bases fitting flush with one another when said hooks engage said bead.

* * * * *